United States Patent [19]

Kimura et al.

[11] Patent Number: 4,645,327

[45] Date of Patent: Feb. 24, 1987

[54] RECORDING APPARATUS HAVING WATER VAPOR REMOVING OR PREVENTING MEANS

[75] Inventors: Kiyoshi Kimura; Yukio Okamoto; Tadashi Miwa; Masakazu Fukuchi; Noriyoshi Tarumi; Kunio Ito, all of Hachioji, Japan

[73] Assignee: Konishiroku Photo Industry Co., Ltd., Tokyo, Japan

[21] Appl. No.: 582,322

[22] Filed: Feb. 22, 1984

[30] Foreign Application Priority Data

| | | | |
|---|---|---|---|
| Feb. 23, 1983 | [JP] | Japan | 58-28904 |
| Mar. 5, 1983 | [JP] | Japan | 58-36221 |
| Mar. 5, 1983 | [JP] | Japan | 58-31716 |
| Mar. 5, 1983 | [JP] | Japan | 58-31717 |
| Mar. 5, 1983 | [JP] | Japan | 58-31718 |
| Apr. 6, 1983 | [JP] | Japan | 58-50293 |

[51] Int. Cl.[4] ..... G03G 15/00

[52] U.S. Cl. ..... 355/3 R; 355/3 FU; 355/30; 219/216

[58] Field of Search ..... 355/3 FU, 3 R, 30; 219/216; 432/10, 42, 65, 60, 228

[56] References Cited

U.S. PATENT DOCUMENTS

| | | | |
|---|---|---|---|
| 3,332,328 | 7/1967 | Roth | 95/1.7 |
| 3,767,300 | 10/1973 | Brown et al. | 355/3 R |
| 3,893,761 | 7/1975 | Buchan et al. | 355/3 R |
| 4,279,501 | 7/1981 | Kojima et al. | 355/15 |
| 4,341,455 | 7/1982 | Fedder | 355/3 T R |

FOREIGN PATENT DOCUMENTS

| | | | |
|---|---|---|---|
| 0149075 | 11/1981 | Japan | 355/3 R |
| 0149074 | 11/1981 | Japan | 355/3 R |
| 0167044 | 10/1982 | Japan | 355/30 R |

*Primary Examiner*—A. T. Grimley
*Assistant Examiner*—David Warren
*Attorney, Agent, or Firm*—Jordan B. Bierman

[57] ABSTRACT

A recording apparatus having an image carrier and a heated intermediate transfer member is disclosed. The improvement is the addition of a shielding member of porous metal for preventing water vapor and/or heat from reaching the surface of the image carrier, wherein the shielding member has a trapping capability for condensing and trapping the water vapor.

10 Claims, 20 Drawing Figures

RECORDING APPARATUS HAVING WATER VAPOR REMOVING OR PREVENTING MEANS

BACKGROUND OF THE INVENTION

1. Field of the Invention

The present invention relates to a recording apparatus wherein toner images formed on the toner image-carrier are transferred onto the recording material.

2. Description of the Prior Art

The outline of the conventional recording apparatus wherein a toner image-carrier is used will be explained below with an example of an electrophotographic copying machine that is of a scanning exposure type. A document to be copied is put on the platen and a copy button is depressed, then the exposure lamp travels in the fixed direction together with an optical system having a reflection mirror and others, irradiating the document. The reflected light corresponding to light and shade of the document is irradiated onto the toner image-carrier (e.g., photoreceptor) that is electrically charged uniformly through aforesaid optical system and thereby electrostatic latent images are formed on the toner image-carrier. Further, toner images corresponding to the density of the document are formed on the photoconductor drum with the aid of developer.

On the other hand, a recording material (e.g., a copy paper) is fed from the paper-feeding device so that it coincides with the position of toner images on the toner image-carrier and then it contacts the toner image-carrier. And then the toner images formed on the surface of the toner-image carrier are transferred to the copy paper with the aid of the transferring electrode, as the toner image-carrier continues rotating in the fixed direction. After that, the copy paper on which the toner images are transferred separates from the toner image-carrier, and it is fed to the roller fixing unit. The roller fixing unit is comprising two rollers at least one of them is heated and it heats and fixes the images formed with the aid of developer on the copy paper. After this, the copy paper is sent out from the copying machine. Meanwhile, the toner image-carrier, after the visible images of toner thereon are transferred to the copy paper, is refreshed by removing remaining toner. And this recording process repeats for every recording. However, when the toner images formed on the toner image-carrier are transferred electrostatically on the copy paper through the transferring electrode such as a corona discharger for example, there is accompanied a disturbance in the electric charge which decreases the resolution of toner images. When the conductive and magnetic toner is given, as a developer in the electrostatic transfer system, the transferring of toner image is substantially impossible.

As a method to improve aforesaid disadvantages in the electrostatic transferring, there has been tried a method wherein pressure rollers press and transfer the images on the transfer sheet but this method has troubles that the transferring efficiency is poor and only half of the toner of toner images is transferred.

In Japanese Patent Examined Publication Nos. 41679/1971 and 22763/1973, Japanese Patent Publication Open to Public Inspection No. 78559/1974 and U.S. Pat. No. 3,993,825, there are proposed methods wherein aforesaid toner images on the toner image-carrier are pressed and transferred on an intermediate transfer member whose transferring layer is made of rubber, and then the images thus transferred on the intermediate transfer member is transferred and fixed concurrently (transfer fixing) on the copy paper by heating and melting of toner caused by a heat roller. In such a method, toner images are pressed and transferred on the outermost layer of the transferring layer made of a rubber, such as silicone rubber or fluorine rubber having a mold releasing property on the one hand and having, on the other hand, the property that adheres fine particles by pressure. Accordingly, the toner images adhered on the transferring layer of the intermediate transfer member are heated, then melted, and then these melting toner images are pressed, and transferred on the copy paper by the releasing property and are finally fixed. Namely, the toner images melted through heating are easily transferred on the copy paper owing to aforesaid mold releasing property of the transferring layer and are fixed. Therefore the resolution of the toner images does not fall through the transferring step, and the transferring rate is high.

The copy paper used for the copying machine wherein the intermediate transfer member is employed should have been heated fully before contacting the intermediate transfer member in order for the toner images on the intermediate transfer member to be transferred and fixed suitably. Consequently, copy paper is required to be fed so that the copy paper contacts the intermediate transfer member after being heated previously by a heat roll or heat plate.

Now, the copy paper generally contains moisture of 4–7% by weight, and when heated, such moisture evaporates and water vapor is produced. Water vapor, when cooled, becomes waterdrops which adhere to the neighboring substances and make them wet.

In the case of a roll type intermediate transfer member, for example, in order to make recording apparatus compact, the heat roll for heating preliminarily the copy paper and other members for the recording process is arranged near the toner image-carrier. However, the water vapor produced from the copy paper might come in touch with the toner image-carrier. If the surface of the toner image-carrier (for example, photoreceptor) touches the water vapor, the water vapor condenses into waterdrops adhering to the photoreceptor because the photoreceptor is kept at a relatively low temperature.

When the toner image-carrier gets wet by waterdrops thereby, the remaining toner on the toner image-carrier condenses and adheres firmly to the toner image-carrier. The toner powder adhered to the wet area on the toner image carrier or the toner powder which is wetted by waterdrops is hard to be removed perfectly by the cleaning unit. Consequently the toner image-carrier, in this case, undergoes the repetition of cycles of charging and others for the next copying, being covered by remaining toner powder. When the toner image-carrier is covered by unexpected toner powder, the area where the toner powder adheres will not be exposed and will not leak charges. Therefore in the developing step, the toner powder further adheres to the area where toner powder previously have adhered, and this is transferred to the copy paper in the transferring step.

Namely, when the toner image-carrier is wetted, the stains or stripes caused by the condensed toner powder adhered to the toner image-carrier 1 appear on the copy paper, which results in the copy being illegible. Likewise, due to waterdrops adhered on the toner image-carrier, normal charging is interrupted and troubles happen in the process of exposure and development.

Further, the toner image-carriers are mostly made of a photoreceptor and the characteristic of the photoreceptor is easily changed by the heat. Therefore, if a heating member is arranged near the toner image-carrier, the heat from the heating member effects the property of charging, then the latent image density will be changed, and troubles take place in recording process.

OBJECTS AND SUMMARY OF THE INVENTION

The object of the present invention is to provide an apparatus wherein a bad influence for the toner image-carrier caused by water vapor and/or heat (at least, radiant heat) can be avoided even if there is arranged near the toner image-carrier the heating member such as a fixing unit or the like that produces water vapor or the radiant heat.

Namely, the present invention relates to a recording apparatus comprising an image-carrier on which electrostatic images are formed and then developed and visualized images thus obtained thereon are transferred onto an intermediate transfer member and then from this intermediate transfer member transferred onto a recording material and are fixed thereon, wherein a preventing means for preventing water vapor and/or heat produced by the heating section for the recording material from arriving at the surface of said toner image-carrier is provided. The invention further relates to a recording apparatus wherein a removing means for removing moisture or water droplets produced on the circumferential surface of aforesaid toner image-carrier is arranged so that it contacts the circumferential surface of aforesaid image-carrier.

DESCRIPTION OF THE PREFERRED EMBODIMENTS

Figure 1:
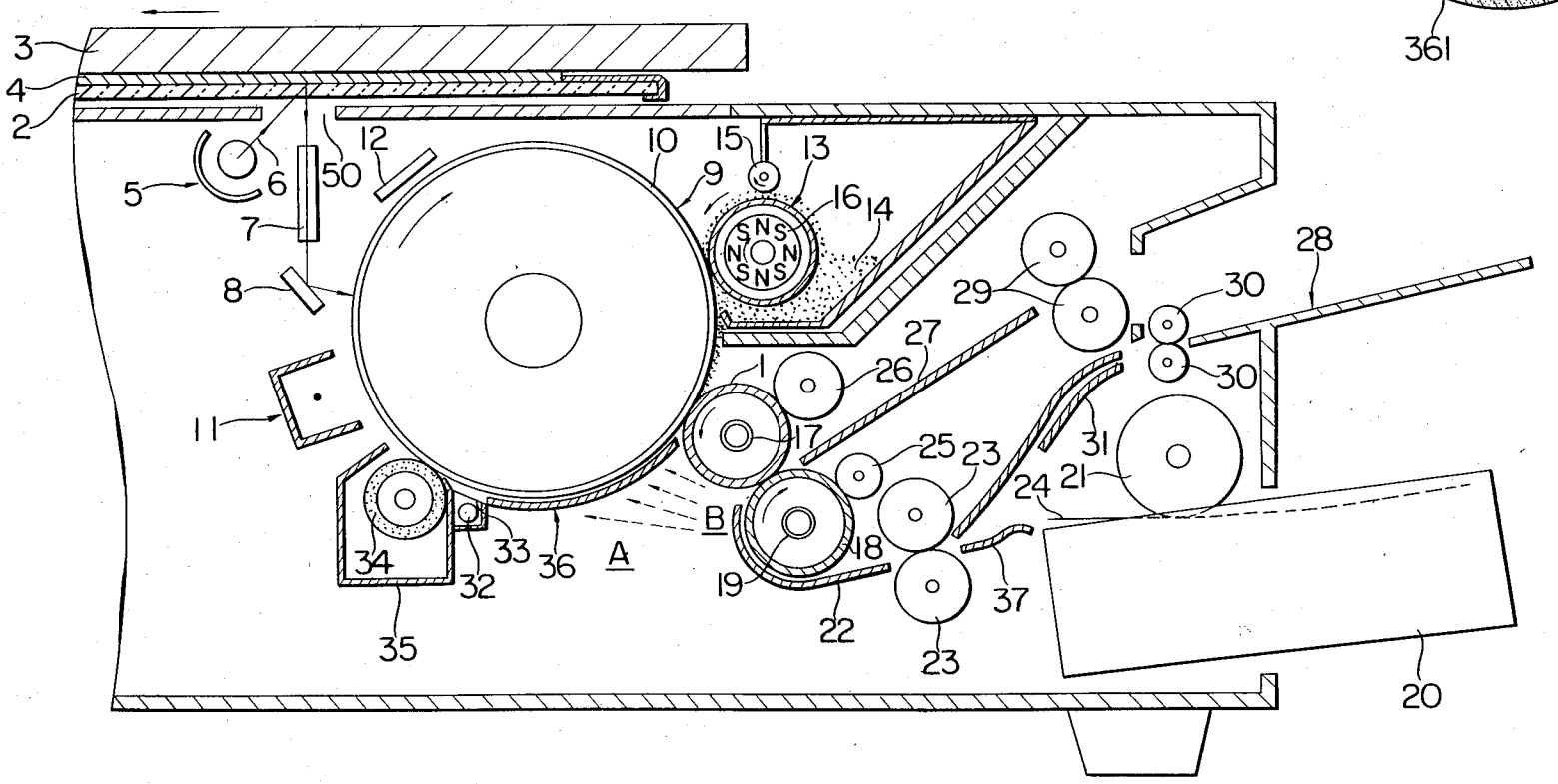
FIG. 1 shows a total schematic structural diagram of the present invention wherein a shielding plate is provided in the copying machine in which an intermediate transfer member is employed.

FIG. 1 shows the outline of the electrophotographic copying machine using an intermediate transfer member wherein a shielding plate is incorporated as a preventing means of the present invention which prevents the water vapor and/or heat produced at the heating section of the recording material from arriving at the surface of the toner image-carrier.

In this copying machine, the document 4 covered by the platen cover 3 is positioned on the glass surface of the platen 2 provided movably on the top wall of the main body. Light 6 from the light source 5 in the main body is irradiated to the document through the slit 50 provided on the top wall of the main body and the reflected light therefrom illuminates the photoreceptor drum 9 through SLA (SELFOC Lens Array) 7 after reflecting on the mirror 8. Therefore, when the platen 2 travels in the direction of an arrow, the exposure is given, according to the pattern corresponding to the images in the document, to the photosensitive layer 10 that is made up of, for example, selenium, organic photoconductive substance and others, and is uniformly charged and thus electrostatic latent images are formed thereon. The numeral 11 in the figure is a corona charger and it charges with a fixed polarity the entire surface of photosensitive layer. Further, the numeral 12 is a light emitting diode array or an electroluminescence plate, or others for preventing a black frame by discharging the area other than an image area on the photoreceptor and prevents toner from adhering to the non-image area. For the photoreceptor drum 9 on which electrostatic latent images are formed, conductive magnetic toner 14 which is widely known is supplied from the developing sleeve 13. This toner 14 is coveyed on the sleeve 13 with its thickness being controlled by a toner thickness controlling magnetic roll 15 and the conveying force thereof is given by the rotation of the sleeve 13 and the rotation of the magnet roll 16 in the sleeve 13. On the toner 14, the inverse charge caused by electrostatic latent images is induced and thereby toner particles move onto the photoreceptor drum 9 successively in proportion to the amount of charge of electrostatic latent images and are attracted thereto. Thus toner images in a certain pattern are formed thereon and they are developed.

The toner images thus formed are then pressure-transferred to the intermediate roll 1 that is contacting to the photoreceptor drum 9 with a pressure that is less than about 1.0 Kg weight/cm (e.g., 0.4 Kg weight/cm). Since the roll 1 has a surface layer whose principal ingredient is a mixture of silicone rubber and fluoro-silicone rubber, toner particles on the photoreceptor drum 9 peel off sufficiently. The toner particles peeled off are transferred to intermediate transfer roll 1, and conveyed to the contact position with the next pressure roll 18, being pre-heated on the roll 1 by the heater lamp 17 in the roll 1 up to a fixed temperature (i.e., the temperature at which the mold releasing property is fully shown). The pressure roll 18 is heated up to a certain temperature by the internal heater lamp 19. Copy paper 24 that is a recording material is conveyed by the paper feed roll 21 from the paper feeding box 20 through the guide plates 37 and 22 and the second feed roller 23 into the boundary between the roll 1 and the roll 18 while being heated. Therefore, the copy paper has been heated to a high enough temperature at which the toner images may be transferred, and when it is fed between both rolls 1 and 18, the toner images already pre-heated are separated from the roll 1 or are transferred and at the same time the toner images on the copy paper 24 may be fixed. Incidentally, the numeral 25 in the figure is a cleaning roller for the pressure roller 18, 26 is a cleaning roller for the intermediate transfer roll 1, 27 is a guide plate for conveying the copy paper after fixing to the paper delivery roller 29 on the side of the paper delivery tray 28, 30 is a roller for feeding out the copy paper from the bottom of the paper delivery tray 28 in the case of duplex copying and 31 is a guide plate for duplex copying.

At the rear step of the intermediate transfer roller 1, light is irradiated from the neutralizing lamp 32 against the photoreceptor drum 9 and thereby the residual charges thereon are eliminated. Further, the cleaning member 34 constituting, for example, of a rubber roller is contacted to the photoreceptor drum 9 and thereby residual toner particles are separated and put in the cleaning device 35 by a scraping blade (unillustrated).

In the invention, for the copying machine with the structure mentioned above, a shielding plate 36 is provided as a preventing means near the circumferential surface of the photoreceptor drum 9 between the intermediate transfer body 17 and the neutralizing lamp 32. Following is a detailed explanation on the action and function thereof. The copy paper 24 is conveyed by the paper feeding roller 21 from the paper feeding box 20 through guide plates 37 and 22 and the second feed roller 23 (the roller for synchronizing toner images with paper feed timing), The paper is heated fully so that toner images on the intermediate transfer roll may be transferred onto the copy paper and fixed thereon. The paper is fully contacted to the pressure roller 18 heated by the heater lamp 19 therein up to a fixed temperature and is pre-heated while it is fed into the boundary between the intermediate transfer roll 1 and the pressure roll 18 which is a transferring and fixing zone.

The copy paper 24 naturally contains moisture of 4–7% by weight and therefore the moisture evaporates since the copy paper is fully contacted to the pressure roll 18 and thereby is pre-heated. And this water vapor, being affected by the direction of rotation of the pressure roll 18 in the clearance between the pressure roll and the guide plate 22, is carried toward the contacting area between the intermediate transfer roll and the pressure roll 18 and then is released from the pressure roll 18 at the point B where the guide plate 22 terminates. In order to heat more sufficiently aforesaid copy paper, a sub-heating member may be provided at certain portions of guide plate 22, or, guide plate 22 may be arranged to be heated.

As the copy volume increases and the number of copy paper 24 to be pre-heated by the pressure roll 18 increases, water vapor obtained through the evaporation of moisture contained in the copy paper 24 increases in proportion to the number of copies to be made and such water vapor tends to stagnate in the place A surrounded by the cleaning device 35, neutralizing lamp 32, photoreceptor drum 9, intermediate transfer roll 1 and guide plate, in particular.

Water vapor becomes a waterdrop when it is cooled and adheres to an object if the object exists in the neighborhood. Water vapor is lighter in weight than the air and in the place of A shown in FIG. 1, it mostly stagnates on the circumferential surface of the photoreceptor drum 9. It is cooled by the photoreceptor drum 9 and waterdrops thus produced adhere to the surface of the photoreceptor drum 9, which has been the cause for the troubles mentioned above.

In order to prevent the water vapor stagnating in the place of A from contacting the photoconductor drum 9, therefore, the shielding plate 36 is provided as a preventing means and water vapor is cooled on the lower surface of the shielding plate 36. Waterdrops thus produced are prevented from adhering to the surface of the photoreceptor drum 9.

With the shielding plate 36 provided, the surface of the photoreceptor drum 9 does not contact with water vapor even if the number of copies to be made increases and water vapor stagnates in the place of A. The shielding plate 36 in FIG. 1 is made of aluminum or other metal sheet. When the pre-heating source for the recording paper and others and the source for fixing are arranged near the toner image-carrier (photoreceptor), the pressure roller 18 has its heating source at the bottom in the right side of the photoreceptor drum 9 in the constitution of FIG. 1. Further, the intermediate transfer roll has a heat source in itself, and therefore the heat energy is radiated as shown in FIG. 1 with an arrow of dotted line.

Therefore, the shielding plate 36 is provided so that at least the radiant heat produced from aforesaid heat sources may not arrive at the photoconductor drum 9. The shielding plate 36 also has a role to prevent aforesaid adhesion of water vapor. The shielding plate 36 may be made of resins as well as of metal.

Figure 2:
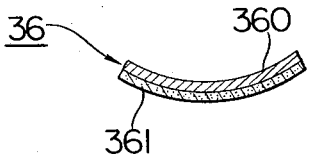
FIG. 2 is a schematic structural diagram showing an example which is different from the shielding means used in the example of FIG. 1.

FIG. 2 shows another example of the shielding plate 36, and the lower surface of the shielding upper plate 360, made of aluminum plate or the like which is opposite to the photoreceptor 9, is made of porous substance that easily absorbs water or of felt material 361 whereby waterdrops adhering to the shielding plate do not fall down and are absorbed in the porous material 361.

Thereby, it is possible to avoid troubles such as rusting of devices below them and a short circuit of electric parts both caused by water dropped.

Aforesaid example is an occasion wherein the present invention is applied in the copying machine in which the intermediate transfer member is employed but further variation of the present invention is available.

In the ordinary copying machine wherein no intermediate transfer member is employed, for example, when a fixing unit having a heating section on the side of photoreceptor drum is provided, it is possible to provide a shielding plate between the photoreceptor drum and the heating section in order to avoid the trouble against the photoreceptor drum caused by water vapor and/or heat produced from such fixing unit. It is possible to effectively prevent the deterioration of the characteristics of the photoreceptor by sheltering the photoreceptor from the radiant heat generated from the heating section.

As stated above in the example of the present invention shown in FIG. 1, it is possible to prevent the water vapor produced from the heating section for copy paper from touching the toner image-carrier by providing the shielding means between the toner image-carrier and the heating section of the fixing unit. Therefore, it does not happen that water that is a condensed water vapor adheres to the toner image-carrier and thereby toner powder does not condense and does not remain on the toner image-carrier. After cleaning the surface of the toner image-carrier with a cleaning unit, it is possible to remove all of the residual toner powder and thereby stripes and scratches which are not owned by the document do not appear on the recording material, which always assures beautiful recordings.

It is possible to control to a certain extent the temperature rise of the toner image-carrier by shielding the radiant heat produced from the heating section with a shielding means, thus it is possible to extend the life of the toner image-carrier.

Figure 3:
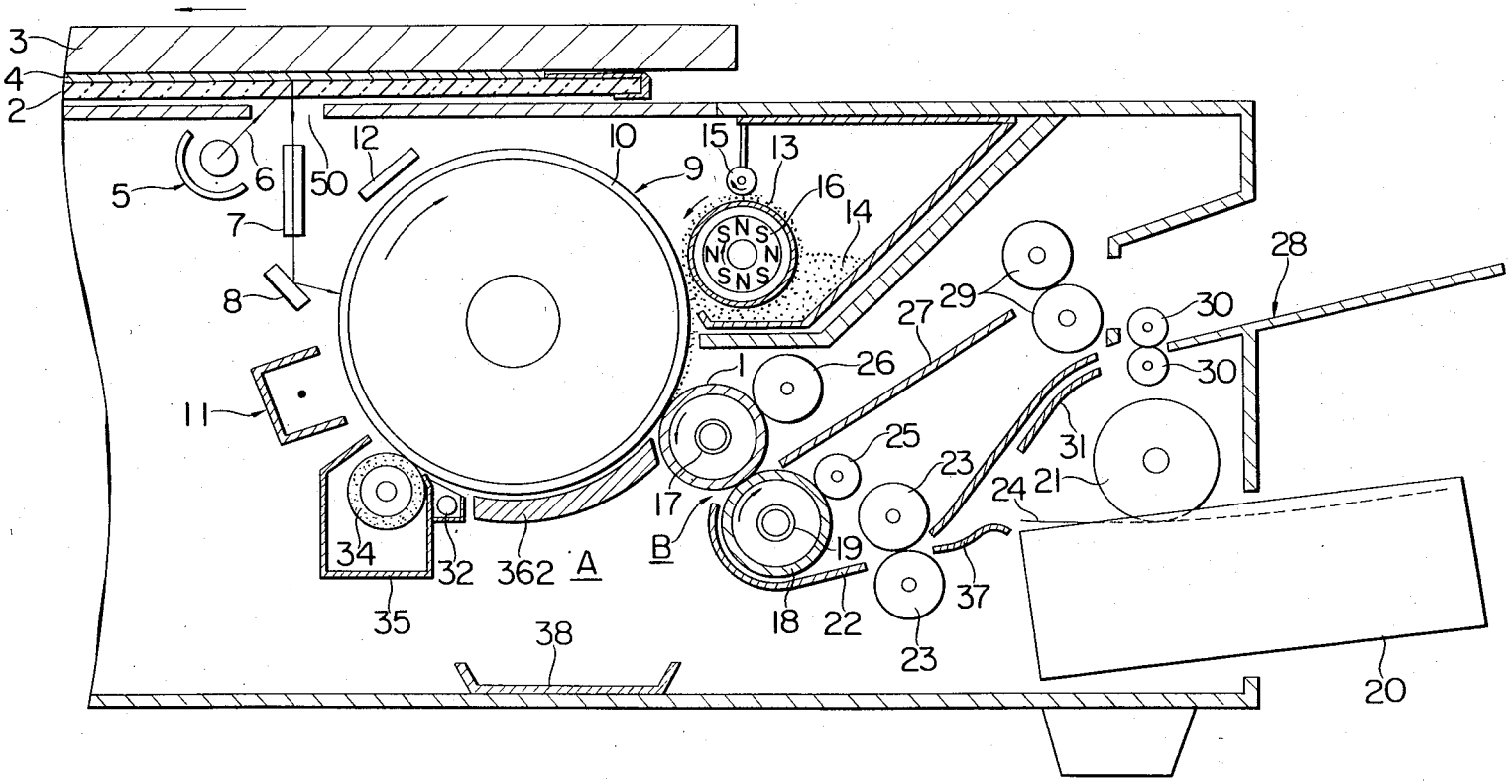
FIG. 3 and FIG. 6 show schematic structural diagrams of other examples of the present invention respectively wherein a trap means is provided in the copying machine in which an intermediate transfer member is employed.

FIG. 3 shows an outline of the electrophotographic copying machine of pressure transfer system wherein a trap device for water vapor is employed as another example of the present invention.

Since the functions of this copying machine are the same as those of the copying machine shown in FIG. 1, parts numbers thereof are the same of those in FIG. 1 and the explanation of the functions thereof will be omitted. In the copying machine shown in FIG. 3, there is provided a trap device 362 for condensing and catching water vapor and preventing condensation on the circumferential surface of the photoreceptor drum 9 between the intermediate transfer member 1 and the neutralizing lamp 32. The action and effect thereof will be explained in detail as follows.

The copy paper 24 is conveyed by the paper feeding roller 21 from the paper feeding box 20 through guide plates 37 and 22 and the second paper feed roller 23 (the roller for synchronizing toner images with paper feed timing), in order to be heated fully so that toner images on the intermediate transfer roll may be transferred onto the copy paper and fixed thereon. The paper is fully contacted to the pressure roller 18 heated by the heater lamp 19 (therein up to a certain temperature) and is pre-heated while it is fed into the boundary between the intermediate transfer roll 1 and the pressure roll 18 which is a transferring and fixing zone.

The copy paper 24 naturally contains moisture of 4–7% by weight and therefore the moisture evaporates if the copy paper is fully contacted to the pressure roll 18 and thereby is pre-heated. And this water vapor, being affected by the direction of rotation of the pressure roll 18 in the clearance between the pressure roll and the guide plate 22, is carried toward the contacting area between the intermediate transfer roll 1 and the pressure roll 18 and then is released from the pressure roll 18 at the point where the guide plate 22 terminates.

Water vapor obtained through the evaporation of moisture contained in the copy paper 24 increases in proportion to the number of copies to be made and such water vapor tends to stagnate in the place A surrounded by the cleaning device 35, neutralizing lamp 32, photoreceptor drum 9, intermediate transfer roll 1 and guide plate 22, in particular.

Water vapor becomes a waterdrop when it is cooled and adheres to an object if the object exists in the neighborhood. Water vapor is lighter in weight than the air and in the place of A shown in FIG. 3, it mostly stagnates on the circumferential surface of the photoreceptor drum 9 and is cooled by the photoreceptor drum 9. Waterdrops thus produced adhere to the surface of the photoreceptor drum 9, which has been the cause for the troubles mentioned above.

In order to prevent the water vapor stagnating in the place of A from contacting the photoreceptor drum 9, therefore, trap device 362 to catch the water vapor is provided and since the water vapor is caught by the trap device 362, waterdrops are prevented from adhering to the surface of the photoreceptor drum 9.

If there is provided a trap device 362, even if the number of copies to be made is increased and the water vapor is successively conveyed to the place of A because of the fact that moisture contained in copy paper is heated, the surface of the photoreceptor drum 9 does not contact with water vapor and thereby no waterdrop adheres thereto because the trap device 362 cools water vapor and catches it.

The trap device 362 may be provided, as shown in FIG. 3, so that it covers the entire circumference surface between the intermediate transfer roll 1 for the photoreceptor drum 9 and the neutralizing lamp 32. It may also be provided between the place B where the water vapor is sent out and the photoreceptor drum 9 like the trap device 363 in FIG. 6.

The material of the trap member constituting the trap device may be resins or ceramics but it is more advantageous to use metal having a high thermal conductivity for cooling the water vapor into waterdrops with condensation and it is more effective to use porous metal having a larger area to contact with water vapor.

Figure 4:
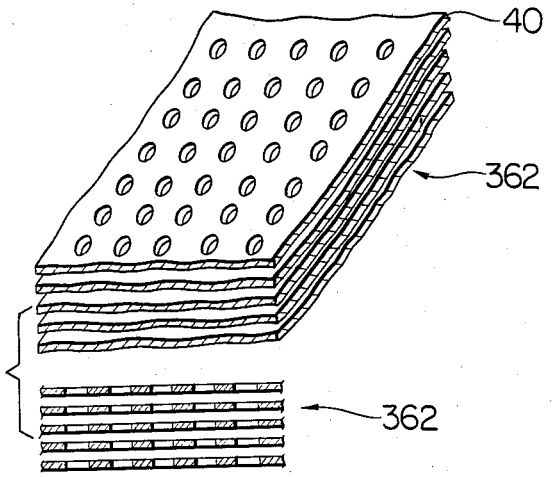
FIG. 4 and FIG. 5 are schematic perspective views and their cross-sectional views of the trap means used in the example of FIG. 3 respectively.
Figure 5:
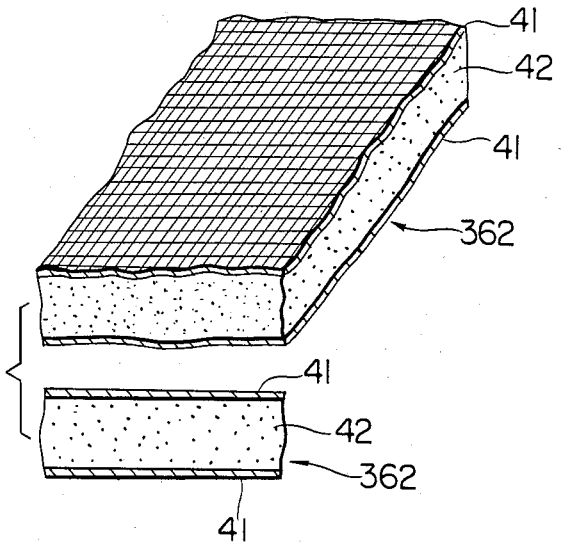

For this reason, the structure of the trap device 362 may be one wherein aluminum plates having many holes are stacked with a certain space between as shown in FIG. 4 or fine aluminum wires or chips 42 are sandwiched between plates having many holes or between wire nets 41 as shown in FIG. 5.

Further, it is effective that the trap device 362 is constituted of ceramics or plastics which is porous or is of honeycomb construction having many holes.

Water vapor caught in the trap device 362 becomes waterdrops. Therefore, the pan 38 for receiving the falling waterdrops may be provided under the trap device and water therefrom may be drained outside.

Further variations of the present invention are available based on its technical philosophy.

For example, a cover member that is a plate having no hole may be fixed on the photoreceptor side surface of the trap device. Further, pipes through which cooling water flows may be buried in the trap device for raising the condensing power of the trap device. Furthermore, when a fixing unit having the heating section near the photoreceptor drum is provided in the ordinary copying machine wherein an intermediate transfer member is not employed, the trap device may be provided between the heating section and the photoreceptor drum for the purpose of preventing the water vapor produced from the fixing unit from contacting with the photoreceptor drum.

Figure 6:
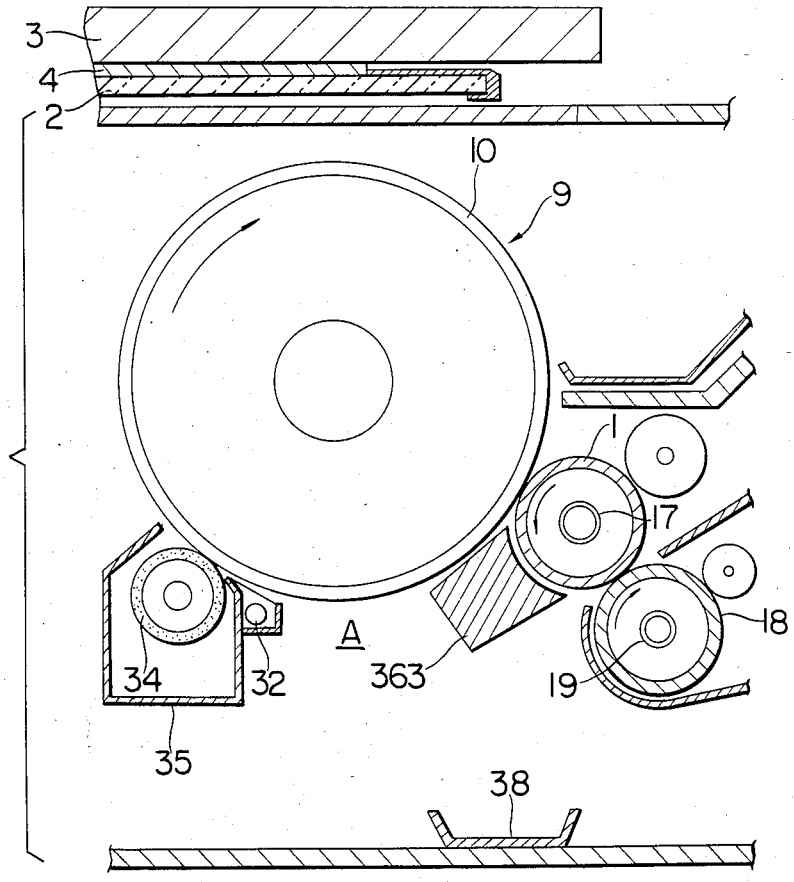

In the examples of the present invention shown in FIG. 3 and FIG. 6, it is possible to prevent the water vapor produced from the heating section from contacting with a toner image-carrier with at trap device that is provided between the toner image-carrier and the heating section of the fixing unit and catches water vapor. Therefore, it does not happen that water vapor is condensed to waterdrops which adhere to the toner image-carrier. So it does not happen that toner powder becomes condensed by water vapor or waterdrops and adheres to the toner image-carrier. If the surface of the toner image-carrier is cleaned by the cleaning unit, all of the residual toner powder is removed therefrom and thereby stripes and scratches which are not owned by the document do not appear on the recording material, which always assures beautiful recordings.

Figure 7:
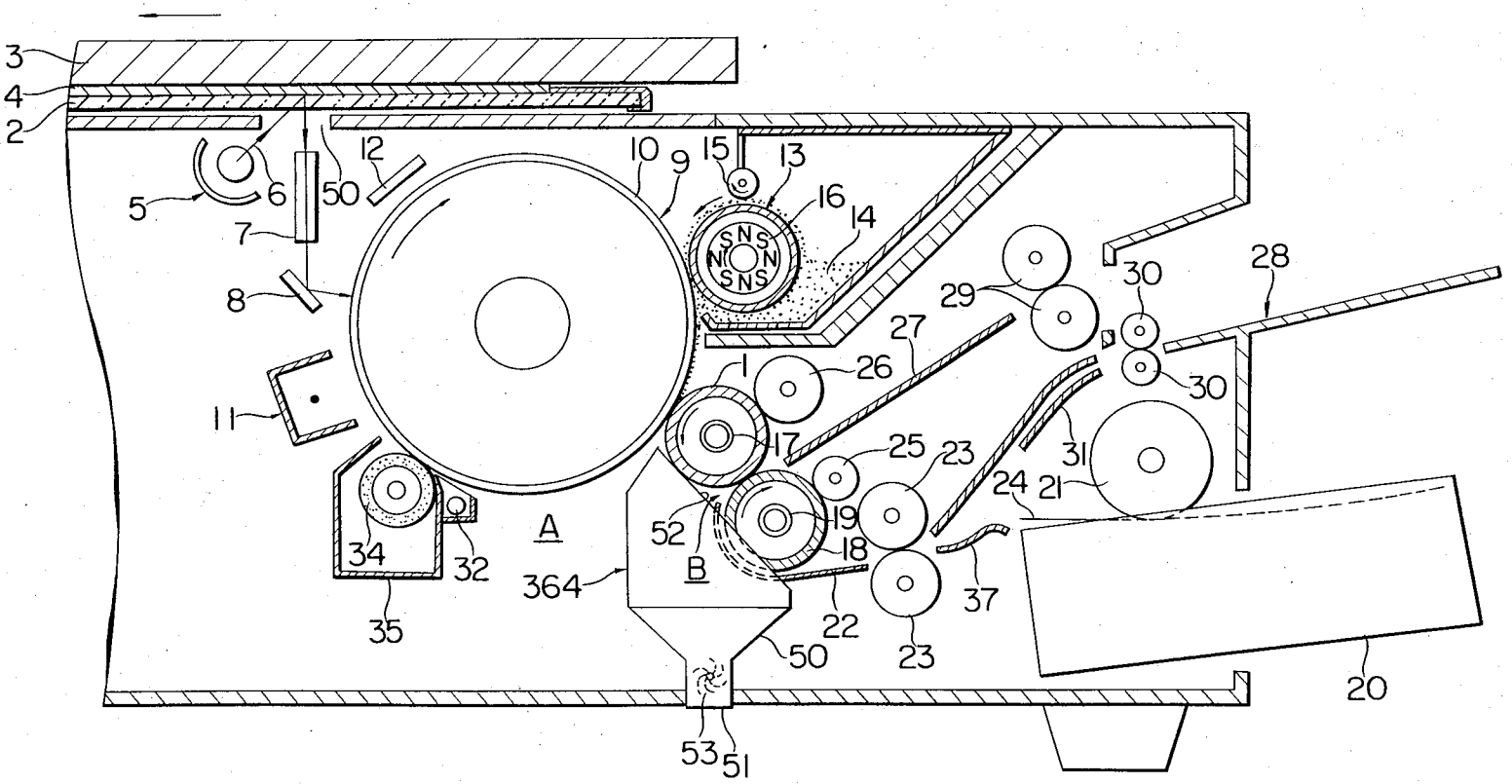
FIG. 7 is a total schematic structural diagram of other examples of the present invention wherein an exhaust means is provided in the copying machine in which an intermediate transfer member is used.

FIG. 7 shows an outline of the electrophotographic copying machine of the pressure transfer type having an exhausting unit as a preventing means that sucks the air containing water vapor and/or heat and then exhausts them outside of the machine, another example of the present invention.

Since the functions of this copying machine are the same as those of the copying machine shown in FIG. 1, parts numbers thereof are the same as those in FIG. 1 and the explanation of the functions thereof will be omitted. What is noticeable in the copying machine shown in FIG. 7 is that there is provided, near the nip portion B of the pressure roll 18 and the intermediate transfer roll 1, the exhausting device 364 for the water vapor produced from the copy paper 24 heated. The actions and functions thereof will be explained in detail as follows.

There is provided an exhausting device 364 between the place B where the water vapor produced, as described previously, from the copy paper 24 separates from the pressure roll 18 and the photoreceptor drum 9. The water vapor conveyed to the place of B is compulsorily exhausted by the device 364 and thereby no water vapor stagnates in the place of A and no water adheres to the surface of the photoreceptor drum 9.

In the example in FIG. 7, the intake 52 of the exhausting device 364 for the water vapor is provided on the left side of the intermediate transfer roll 1 and the pressure roll 18 for inhalation of water vapor and the water vapor inhaled is guided to the exhausting duct 50 and then is exhausted outside from the outlet 51 located on the bottom of the copying machine.

Figure 8:
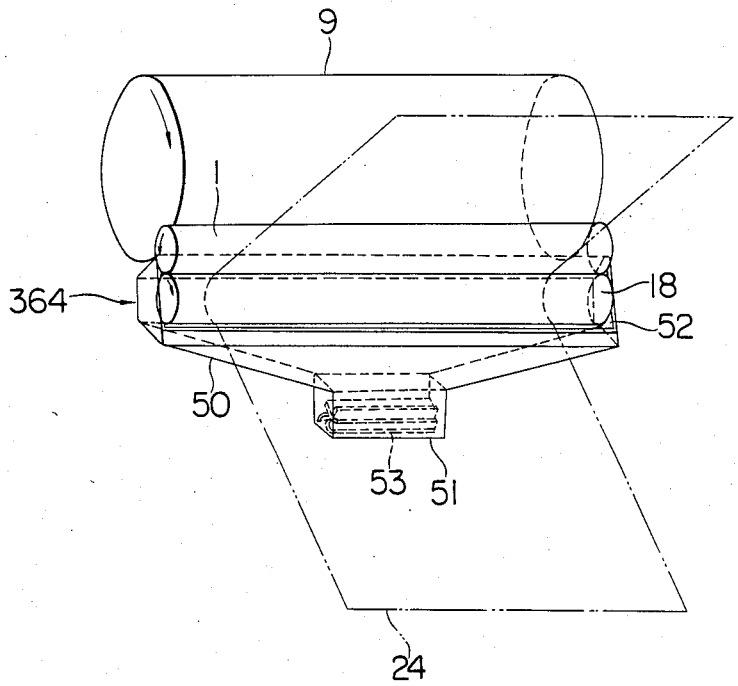
FIG. 8 is a perspective view of a key portion including the exhaust means used in the example of FIG. 7.
Figure 10:
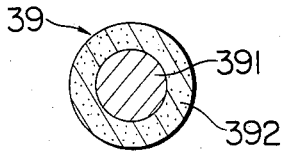
FIG. 10 and FIG. 11 are the cross-sectional views of the moisture-removing roll used in the example of FIG. 9 respectively and FIG. 12 is a schematic sectional view of another example of the moisture-removing roll.

FIG. 8 is a perspective view that clarifies the exhausting device 364. In this example, the outlet 51 is located at the center of the bottom of the copying machine but it may also be located on the side of the copying machine without being limited to the bottom.

The duct of the exhausting device 364 may be constituted of unified aluminum or heat-resisting resins or of the combination thereof.

In the example of the present invention shown in FIG. 7, the water vapor is exhausted outside owing to the exhausting means for the water vapor produced from the heating section provided near the heating section of the fixing unit and it is possible to prevent water vapor from contacting with the toner.

Figure 9:
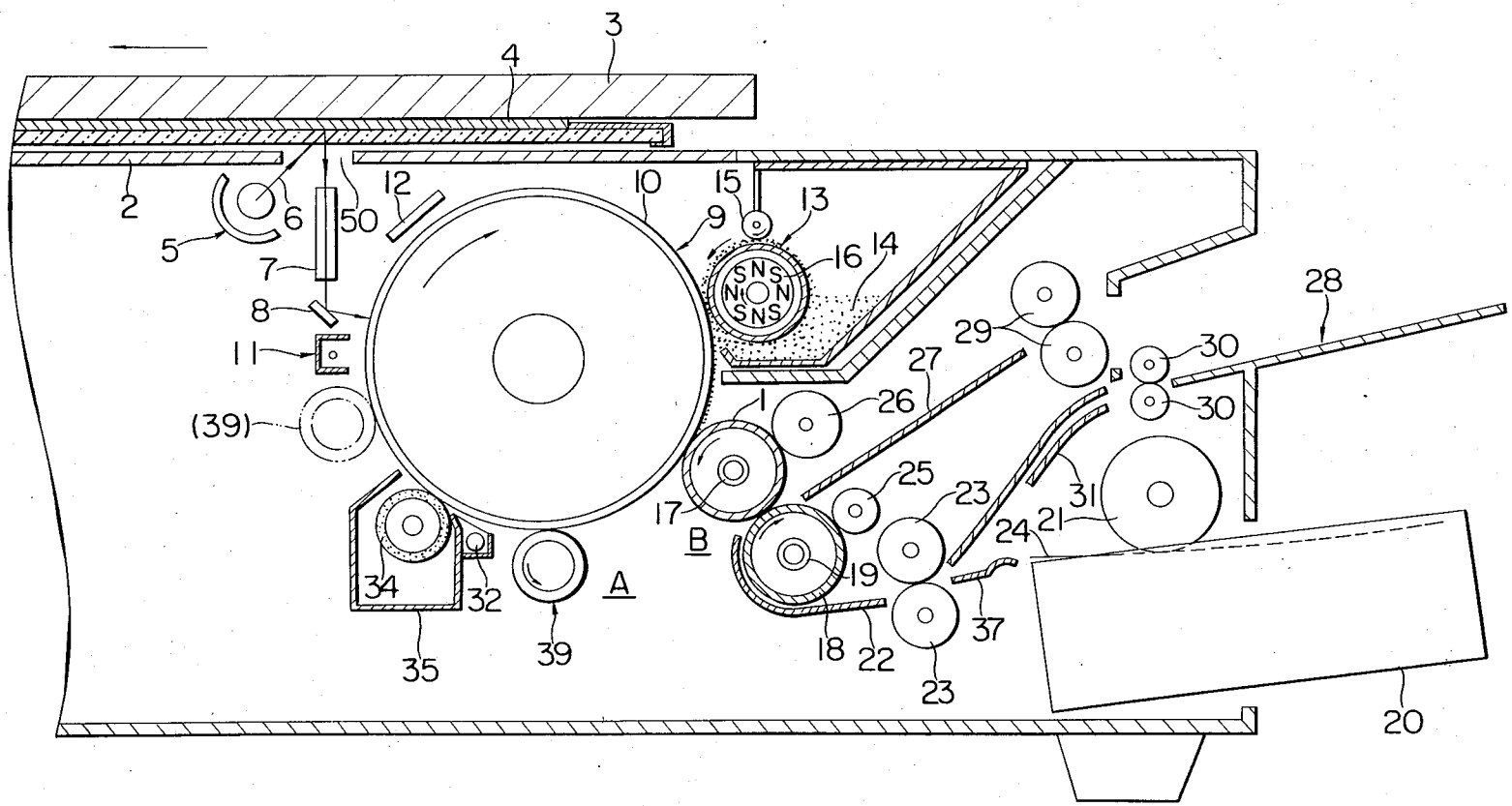
FIG. 9 is a total schematic structural diagram of another example of the present invention wherein a moisture-removing roll is provided in the copying machine in which an intermediate transfer member is used.

FIG. 9 shows an outline of the electrophotographic copying machine of the pressure transfer type having a removing means for the water adhered on the surface of the toner image-carrier, as another example of the present invention.

Since the functions of this copying machine are the same as those of the copying machine shown in FIG. 1, parts numbers thereof are the same as those in FIG. 1 and the explanation of the functions thereof will be omitted. What is noticeable in the copying machine shown in FIG. 9 is that there is provided a removing means 39 for the water formed on the circumferential surface of the photoreceptor drum 9 between the intermediate transfer roll 1 and the neutralizing lamp 32. The actions and functions thereof will be explained in detail as follows.

Water vapor stagnating at the place of A contacts with the photoreceptor drum 9 and thereby becomes waterdrops thus water adheres to the surface of the photoreceptor drum 9. But if such water is removed by the water-removing means 39 provided, the surface of the photoreceptor drum 9 may arrive at the cleaning unit 35 that is a next step with no water adhered or in a condition of dryness and thereby residual toner powder may be removed sufficiently. Thus the next copying step can be started in the clean condition.

The water-removing means 39 will be explained next. In the example shown in FIG. 9, the water-removing means 39 is constituted of an aluminum shaft 391 in the form of a roll and a covering member 392 that is made of felt or sponge urethane.

The water-removing means 39 is formed in the form of a roll and when it contacts with the photoreceptor drum 9, the rotating force of the photoreceptor drum 9 is transmitted to the water-removing means 39 and thereby the water-removing means 39 starts rotating counterclockwise as shown with an arrow. As the water-removing means 39 rotates, the entire surface of the water-removing means 39 contacts with the photoreceptor drum 9 thus it is possible to absorb sufficiently the water adhered to the surface of the photoreceptor drum 9. The superficial layer 392 of the water-removing means 39 is made of felt or sponge urethane and these materials are porous and elastic and therefore when they are pressed, the entire surface of the photoreceptor drum 9 contacts with these materials, which constitutes three functional sections near the contacting area (nip portion). First section, to begin with, is an entrance part of the nip portion which is an exhausting portion where the air is exhausted from air gaps (pores) in the layer due to the compression deformation of the elastic layer. Second section is a central part of the nip portion where the compression deformation is promoted and restored relatively gently and water percolates into pores with its wettability. Third section is an exit part of the nip portion where the elastic layer returns quickly to its original state and the elastic layer has transiently the negative pressure and it further is an absorbing section where the percolation action caused by the pressure difference is sufficiently active at the boundary plane between the roller (water-removing means) and the photoreceptor surface. In this way, the percolation action caused by the pressure is also activated, besides the percolation action toward the roller owing to the wettability, by generating the absorbing force at the exit part with an external pressure against the deformation layer having pores, thus it is possible to remove extremely effectively the water adhered to the photoreceptor drum 9 and it does not happen that some water adhered to the photoreceptor drum 9 fails to be removed.

Figure 11:
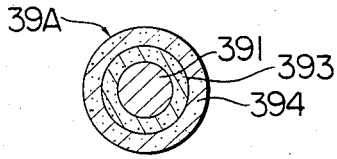

Further, a water-removing means for removing water may have a laminated structure wherein the shaft 391 is made of aluminum which is surrounded by sponge urethane 393 that is further surrounded by felt 394 as a superficial covering material, as shown in the water-removing means 39A in FIG. 11.

Figure 12:
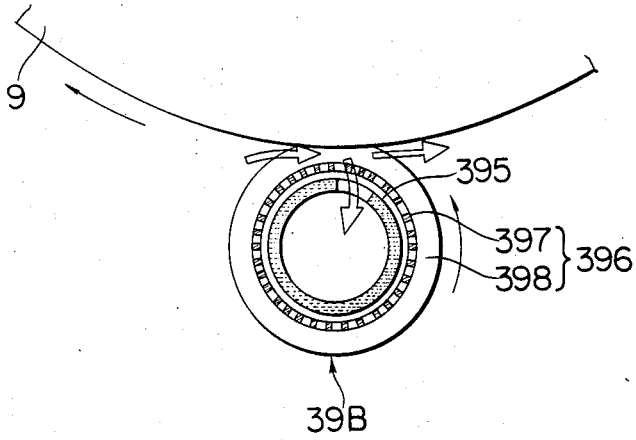

It is desirable that the surface of the water-removing means 39A which contacts with the photoreceptor drum 9 is given a hydrophilic treatment such as a coating of a substance having a hydrophilic group like hydroxyl group, amino group and sulfonic acid group or an impregnation thereof, in order to raise the water-absorbing power. The water-removing means 39B shown in FIG. 12 is another example of water-removing means which is more effective. Namely, holes are prepared continuously or intermittently in the axial direction on the upper side (nip side) of the fixed sleeve 395 of the water-removing means 39B and the water-removing roll 396 is provided rotatably around the fixed sleeve. The water-removing roll 396 is of the structure wherein the permeable core bar 397 having many holes thereon is covered by the porous elastic layer 398 such as sponge and an air flow represented by white arrows is produced by the rotary motion represented by black arrows, thus it is possible to take the wet air in the fixed sleeve 395. A suction duct may be provided on one end of the fixed sleeve 395.

In the example, the water-removing means 39 is provided between the intermediate transfer roll 1 and the neutralizing lamp 32 but it may be positioned between the corona charger 11 and the cleaning unit 35 as shown by virtual lines in FIG. 9 by moving it in the direction of the rotation of the photoreceptor drum 9.

Further variations of the present invention are available based on its technical philosophy.

For example, it is possible to give aforesaid hydrophilic treatment to the surface of the cleaning roller 34 in FIG. 9 and thereby to cause it to have two roles of toner-removing and water-removing. Further, when the fixing unit having the heating section near the photoreceptor drum is provided in the ordinary copying machine wherein no intermediate transfer member is employed, the present invention can be applied for the purpose of removing the water transformed from the water vapor produced from the fixing unit and adhered to the photoreceptor drum.

Figure 13:
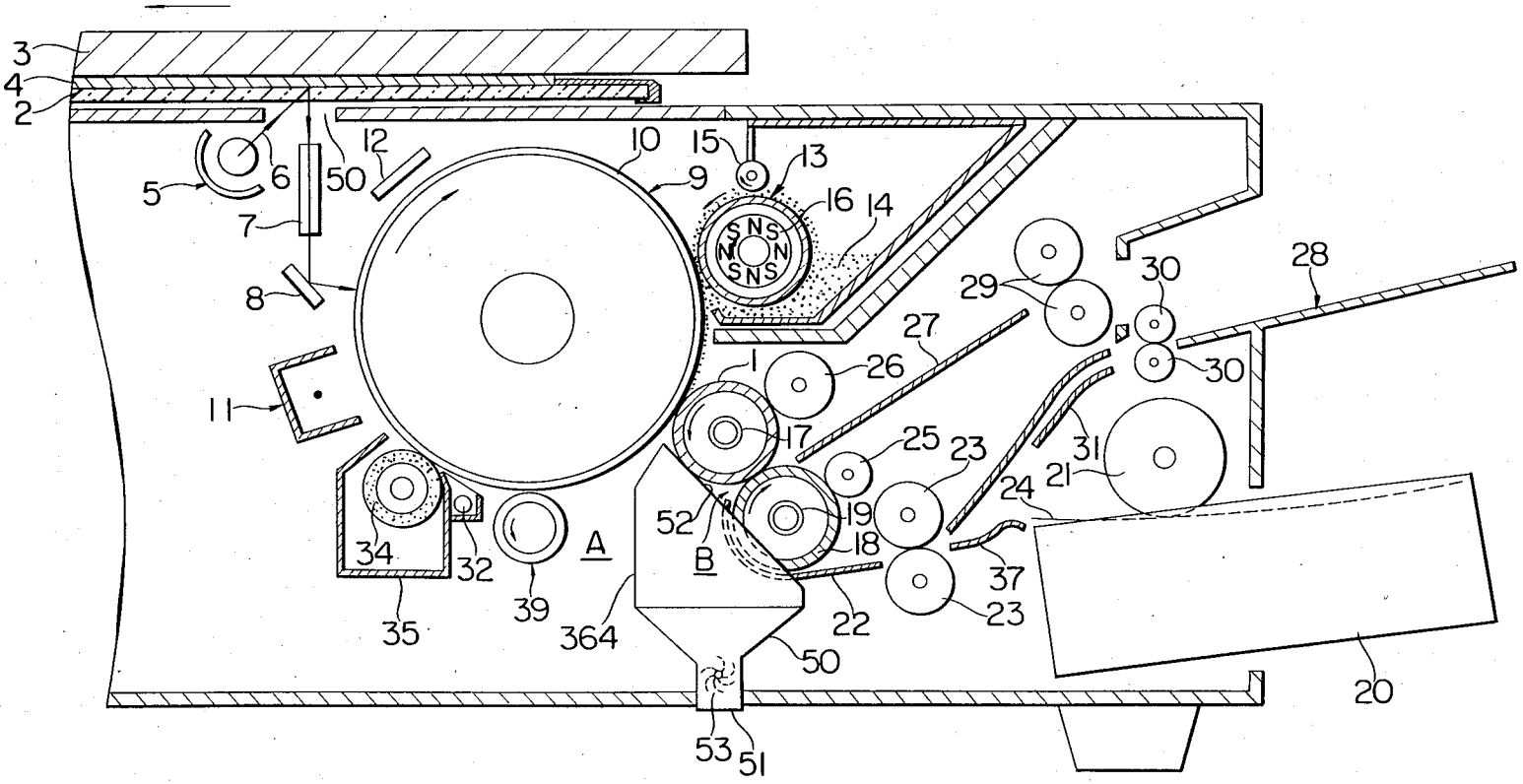
FIG. 13 is a total schematic structural diagram of another example of the present invention wherein a moisture-removing roll and an exhaust means are provided in the copying machine in which an intermediate transfer member is used.
Figure 14:
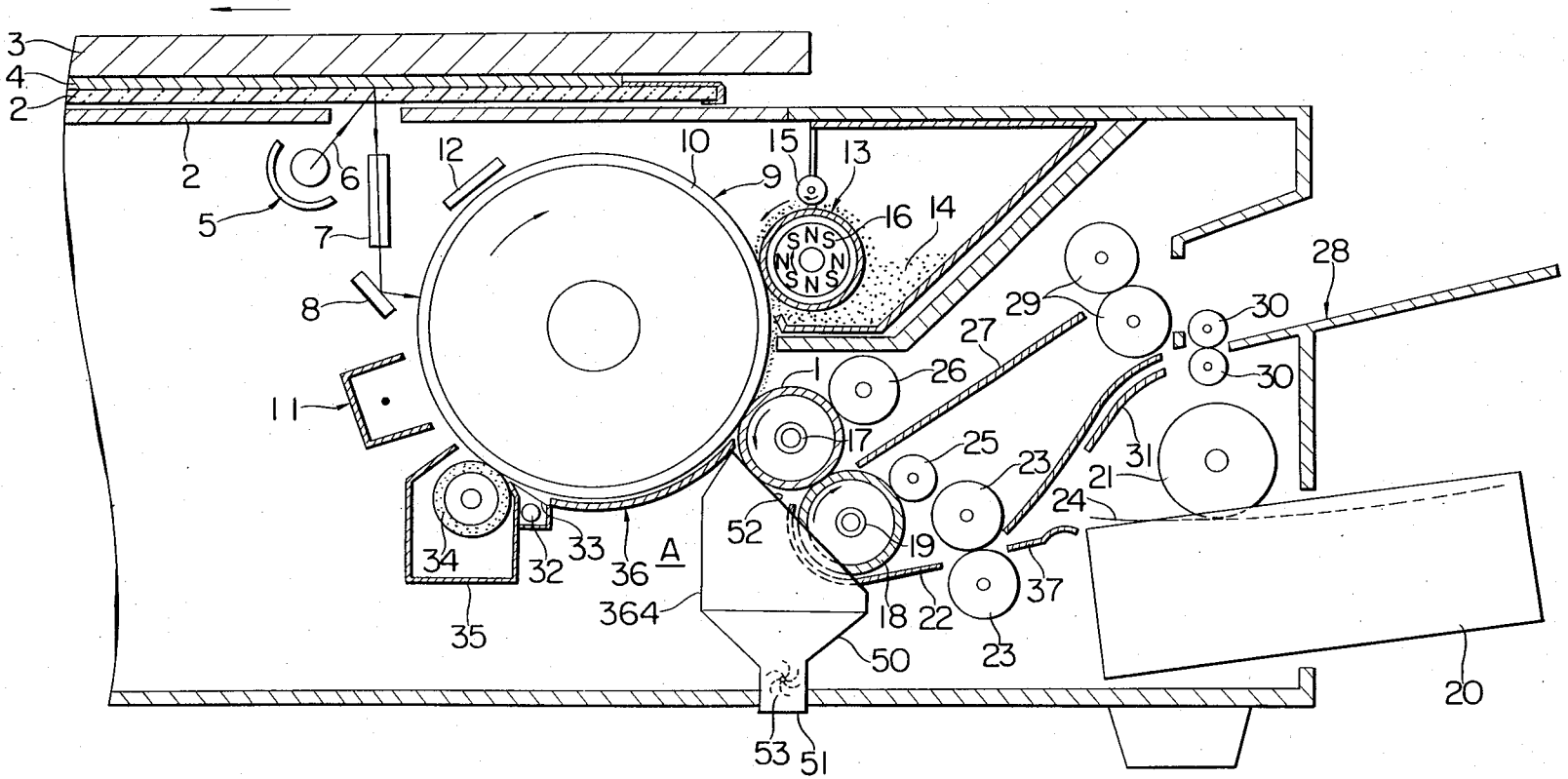
FIG. 14 is a total schematic diagram of another example of the present invention wherein a shielding plate and an exhaust means are provided in the copying machine in which an intermediate transfer member is used.

The present invention has been explained referring to several examples and the combined use of these examples further assures the effect of the present invention. FIG. 13 and FIG. 14 show these examples respectively. FIG. 13 shows an example wherein a water-removing means 39 that is explained in the example of FIG. 9 and removes water adhered to the surface of the photoreceptor drum 9 and an exhausting device 364 explained in the example of FIG. 7 are jointly employed, while FIG. 14 shows an example wherein a shielding plate 36 explained in FIG. 1 and an exhausting device 364 explained in the example of FIG. 7 are jointly employed. The present invention has further assured its effect explained above by such combined use of the examples.

As described above, the intermediate transfer member pre-heats the copy paper and the temperatures of the intermediate transfer member, pressure roll and the photoreceptor drum that is a toner image-carrier change owing to the heat source arranged in the intermediate transfer member and/or the pressure roll provided in the manner that it contacts the intermediate transfer member with a pressure and to the movement of the heat through radiation, conduction and convection from the heat source. Especially, the temperature rise at the point where the photoreceptor drum touches the intermediate transfer member tends to be higher than the other part.

The heat distribution thus lacks uniformity and causes the localized high temperature, or the high temperature over the entire part is sometimes caused. When the temperature of the photosensitive layer arrives at the point that is higher than a certain temperature, the charging characteristic of the photosensitive layer and the sensitivity characteristic thereof change and the image density sometimes drops causing troubles against the recorded materials. In the case of selenium photosensitive layer, for example, the characteristic thereof deteriorates remarkably when the temperature is 50° C. or more. Therefore, the photoreceptor drum is required to have the structure that prevents the temperature rise with an excellent radiation of heat.

Namely, how to prevent the rise in temperature of the photoreceptor is an important matter and there has been suggested the constitution wherein plural cooling fins are formed radially on the internal circumferential surface of the drum body (base member) of aforesaid photoreceptor drum and they accelerate the spontaneous heat radiation together with the rotation of aforesaid photoreceptor drum. In the case of the photoreceptor drum having such cooling fins fixedly formed on the inside surface of the drum body, the drum body equipped with expensive cooling fins is scrapped for replacement together with the photosensitive layer owing to the damage or deterioration of the photosensitive layer. Then, extremely useful cooling may be attained easily in the constitution wherein a cooling device equipped with a heat exchanging means (cooling fins or the like) is provided inside the photoreceptor body in a detachable manner and a metallic cylinder having therein a heat exchanging means such as cooling fins or the like and an air-sending means to send an air current to the metallic cylinder are provided therein.

An example will be explained as follows referring to FIG. 15, FIG. 16 and FIG. 17.

Figure 15:
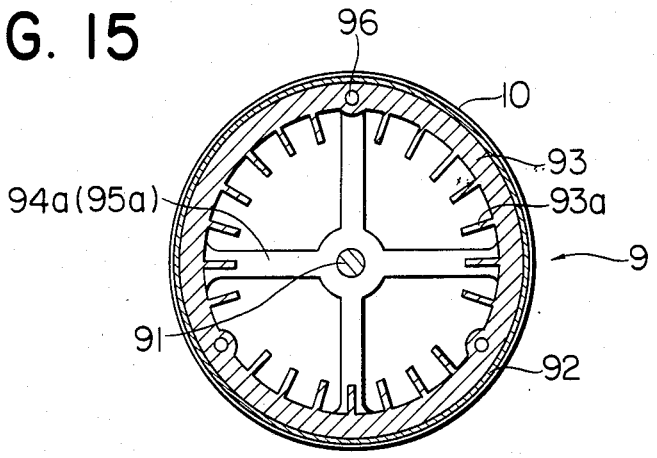
FIG. 15 is a schematic diagram wherein one example of the toner image-carrier drum equipped with a detachable cooling drum is viewed in the axial direction thereof.
Figure 16:
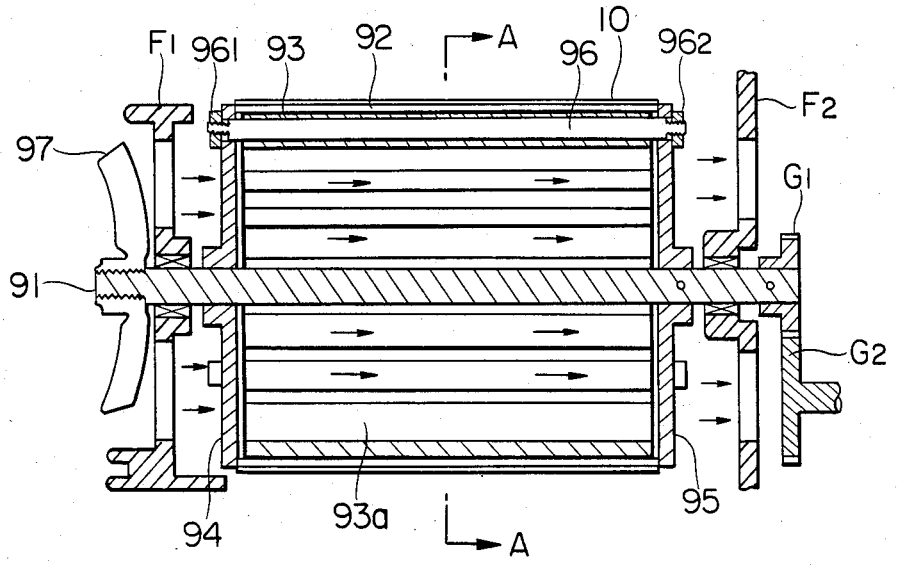
FIG. 16 is a schematic diagram that shows the state of the toner image-carrier drum in FIG. 15 mounted on the recording apparatus which is viewed in the sectional plane including the axis thereof.

FIG 15 is a cross-sectional view of a photoreceptor drum taken on line A—A in FIG. 16; and FIG. 16 is a schematic sectional illustration of the structure of a photoreceptor drum taken on line in parallel with the durm shaft.

The both ends of drum shaft 91 are bearingwise supported respectively by front frame $F_1$ detachably fixed to the machine body and rear frame $F_2$ fixed thereto, so that the drum shaft may be revolved through gears $G_1$, $G_2$, by the power of the copying machine. Photoreceptor drum substrate (base member) 92 comprising, for example, a thin metal cylinder, and having photosensitive layer 10 on the outer circumference thereof, and cooling drum 93 having cooling fins 93*a* capable of touching internally to and getting detachably into the base member of the photoreceptor drum, the both are arranged between the frames, $F_1$, $F_2$. The openings at the both ends of the cooling drum are held respectively by front flange 94 and rear flange 95 and the both ends of the cooling drum 93 are tightly fastened down in some places thereof to flanges 94, 95 by bolts 96 and nuts 961, 962. In this example, the photoreceptor drum substrate 92 is thin in thickness as it is of the order of 0.2 mm and is made longer to some extent than cooling drum 93. Therefore, both ends of the photoreceptor drum substrate 92 are pressed a little by the described tight fastening so as to come into close contact with and to be fixed to the cooling drum 93 and flanges 94, 95. Flange 95 on the rear side of the copying machine is fixed to drum shaft 91 by a set pin or the like. On the other hand, flange 94 on the front side of the machine is arranged so as to be slidable along the drum shaft 91.

When the drum shaft 91 is revolved by the power of the copying machine through gears $G_1$, $G_2$, both of photoreceptor drum substrate 92 and the cooling drum 93 are also revolved in a body, and at the same time propeller blades 95 attached to the end of the drum shaft 91 are also revolved to inhale the open air so as to make an air current in the direction of the arrow, in the cooling drum 93. Therefore, the described cooling fins 93*a* provided to the inner circumference of cooling drum 93 perform an effective heat radiation so that such effects may be displayed as to inhibit a rise in temperature of the photoreceptor substrate 92, and to make the heat distribution uniform. The described frames $F_1$, $F_2$ are provided with air vents, respectively, and described flanges 94, 95 are provided with air vents, respectively, which are formed of ribs 94*a*, 95*a* so that the described air current may be formed.

The photoreceptor drum substrate 92 thus constructed may readily be separated and detached from the cooling drum 93 even when the chargeability thereof is lowered or when the replacement thereof is required because of abrasion or damage of the substrate 92.

In separating or detaching, propeller blades 97 fixed to drum shaft 91 by screws or the like are removed from drum shaft 91 toward the front side of the machine, and the frame $F_1$ is then removed from the machine body toward the front side. Next, when removing the fastened nut 961 from bolt 96, flange 94 may also be removed toward the front side. Thereby, the photoconductor drum substrate 92 being held may readily be removed toward the front side (in the left in FIG. 16). In reversing the procedure, a new photoreceptor drum substrate 92 may be substituted for the old one or may be fitted. Cooling drum 93 with the cooling fins may be used semipermanently without intermittence. In this example, an air current may be drawn to the cooling fins 93*a* of the cooling drum 93 without a separate power source. Propeller blades 97 may also be driven to revolve through gears and the like.

The described photoreceptor drum substrate 92 is of a very thin metal cylinder of the order of 0.2 mm in thickness and it may be made in a known electroforming method. According to the method, a seamless, long, thin cylinder may be made by the use of such a material as aluminum, nickel, chromium, zinc, brass or the like and by utilizing a metal electrodeposition that is the same as a plating.

Figure 17:
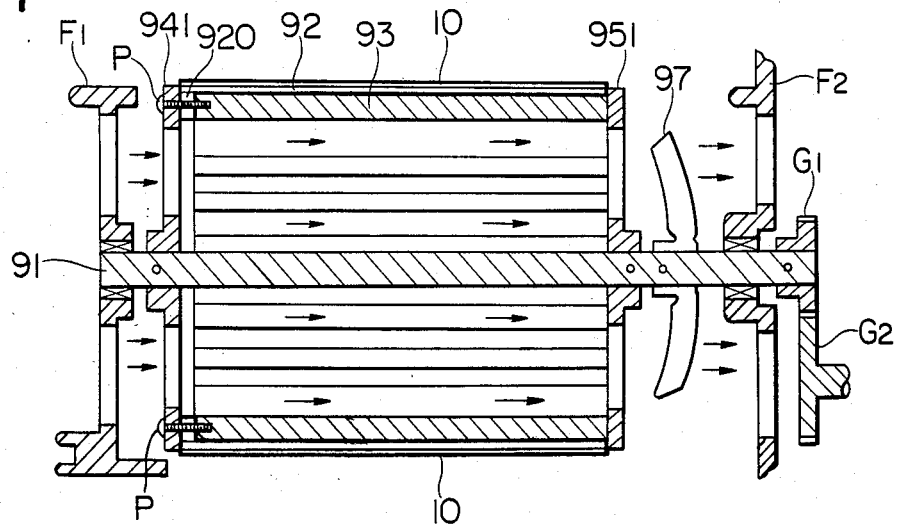
FIG. 17 is an illustration that corresponds to FIG. 16 and shows other toner image-carrier drum mounted.

FIG. 17 illustrates another example, wherein photoreceptor drum substrate 92 having thereon a photosensitive layer 10 is so constructed that a ring 920 is welded into or adhered to one end of the substrate 92 so as to become in a body and to be sandwiched between flange 941 and drum body (cooling drum) 93 and also to be screwed by a screw. Thereby, the drum substrate 92 is assembled in a body with drum shaft 91 so as to be revolved.

Accordingly, similar to the aforedescribed Example, 1, the photoreceptor drum substrate 92 may readily be detached. Namely, frame $F_1$ is removed from the machine body of the copier toward the front side (in the left in the drawing) of the machine, and the screw P is removed. Thereby, flange 941 and photoreceptor drum substrate 92 may be removed toward the front side and the photoreceptor drum substrate 92 may be replaced. Even if the photoreceptor drum substrate is replaced, cooling drum 93 may still be used continuously.

As shown in this example, propeller blades 97 are arranged in the positions on the rear side corresponding to the positions in the case of Example 1 described above to inhale the air from the inside of cooling drum 93, and thereby, an air current may also be formed in the cooling drum 93, as shown by the arrow.

In the other example, similar to the example shown in FIG. 17, the photoreceptor drum substrate is united with a ring in a body by welding into or adhering to one end of the drum substrate, and it is fixed by screw to the side of the cooling drum. The cooling drum substrate is so constructed as to be fixedly sandwiched between the flanges. In this example, if the frame on the front side is removed and the described screw is then unscrewed, the photoreceptor drum substrate may readily be detached without removing the flange. In addition, the drum shaft may also be divided into two parts in the bilateral direction in FIG. 17 so as to further improve an air current. It is also allowed that the cooling fins are twisted to the axis so as to radiate as well as to generate an air current.

It is the matter of course that such cooling fins for generating the air current may also be revolved by an additional driving power source such as a motor. Further, an air current may be introduced from the other place into the drum through a duct.

As described above, in a copying machine and the like using an intermediate transfer member shown in FIG. 1 and the like, with the purpose of keeping the photoreceptor drum uniform and cool to serve as an image carrier, the photoreceptor may be so constructed as to be replaced readily its by providing a drum having its cooling fins and by making the photoreceptor drum detachable.

Incidentally, even when the described cooling fins are formed to cool down the photoreceptor drum so as to try to stabilize an image quality, the temperature of the photoreceptor drum may be raised and the cooling function on the both ends thereof lowered as the wind blows from the fans into the photoreceptor drum, and the temperature of the photoreceptor drum may not be uniform in the axis direction thereof, which is a critical problem to be solved.

In the prior art, the irregular distribution of temperature will result, because the configuration of the conventional radiating (cooling) fins have been symmetrical with respect to the center in the direction of the drum shaft.

After repeated studies of the shape of cooling fins, the following constitution attains an extremely great effect as a cooling mechanism in which the toner image-carrier is cooled with less temperature difference in the direction of the rotating shaft thereof.

Namely, by sending the air through the inside of the drum body of the image carrier, aforesaid image-carrier is cooled and when providing a heat-radiating means such as cooling fins or the like inside the drum body, the heat-radiating efficiency of the heat-radiating means is made greater at the windward side than at the leeward side.

Following is a concrete illustration made referring to the drawings.

Figure 18:
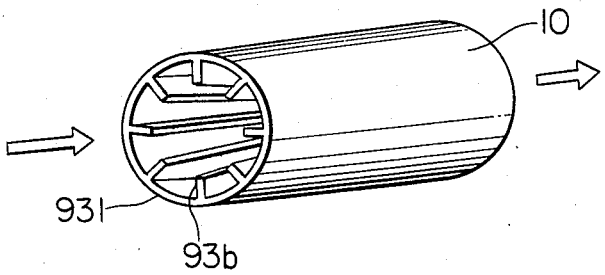
FIG. 18 shows an example of the perspective view of the toner image-carrier drum wherein the shape of the cooling fin is different from the conventional one and thereby the cooling efficiency thereof is better, and a white arrow represents an advance of the wind caused by the fan.

FIG. 18 is a drawing wherein the cooling drum body (base member) 931 of the photoreceptor formed as an image-carrier on the circumferential surface of the photosensitive layer 10 and cooling fins 93*b* are viewed perspectively and a white arrow therein shows a direction of the wind produced by a fan (unillustrated).

Figure 19:
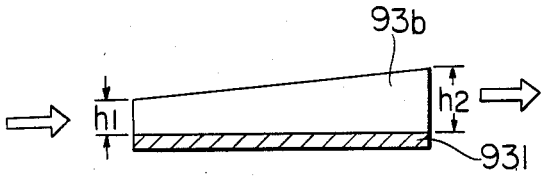
FIG. 19 shows a general form of a side view of cooling fins provided on the internal wall of the drum in FIG. 18.

Cooling fins 93*b* arranged on the internal wall of the drum body 931 in parallel with the axis thereof have their side view shown in FIG. 19 and the height of the fin changes from $h_1$ to $h_2$ ($h_2 > h_1$) according to the direction of the wind thus the surface area of the fin increases accordingly thereby the cooling efficiency at the leeward side is greater than that at the windward side. Besides what are shown in FIG. 18 and FIG. 19, the shape of the cooling fin may be formed on the internal wall of the drum body 931 with an inclination against the axial direction thereof or it may be formed in a spiral form.

Figure 20:
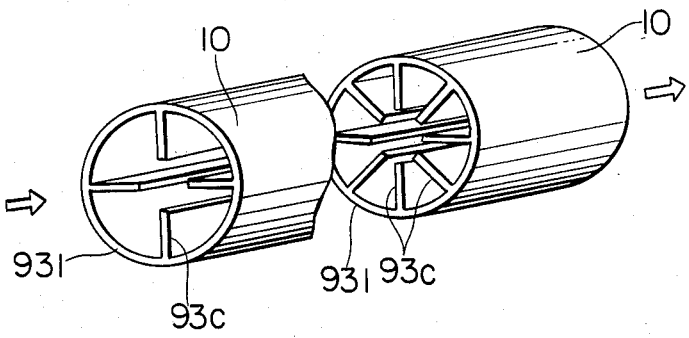
FIG. 20 is a schematic illustration showing an example wherein the number of cooling fins to be arranged on the internal surface of the image-carrier drum increases according to the advancing direction of the wind.

As shown in FIG. 20, on the other hand, the number of the cooling fins 93*c* on the leeward side is larger than that on the windward side thus the cooling efficiency at the leeward side is greater in general though the cooling efficiency changes stepwise.

As stated above, the heat-radiating fins whose surface area increases as it moves from the windward side to the leeward side are provided on the internal wall of the drum body through which the cooling wind passes. Thereby even if the temperature of the cooling wind rises as it moves from the windward side to the leeward side, it does not happen that the cooling efficiency drops accordingly. Consequently the photosensitive layer 10 is cooled so that the temperature thereof will be uniform in the direction of the drum shaft and stable electrostatic images having uniformity in its lateral direction are formed and images with an excellent image quality are thus recorded.

In the present invention, as stated above, there have been attained extremely great effects such as an effect to prevent the water vapor produced when pre-heating the copy paper (recording material) from adhering to the photoreceptor or to eliminate water vapor even if it adheres to the photoreceptor, or an effect that an toner image-carrier can easily be replaced without any waste owing to the cooling fins that cool uniformly the toner image-carrier drum, which tends to be high temperature locally being caused by the contact with an intermediate transfer member, and that are detachable. In above explanation as the examples of this invention, it is explained that the base member of the toner image-carrier is made of metal, for example, such as aluminum. The base may also be made of plastics as a preferable base of the toner image-carrier. In case of using plastics as the essential material of basic substance, because the specific heat of plastics is larger than that of metals, waterdrops will not occur on the surface of the photoreceptor made on the base member (basic substance) by adhesion of water vapor.

Example of application of plastics base is explained in detail as follows.

Especially when the basic substance (base member) such as a photoreceptor drum or the like is made of metal such as aluminum for example, the weight of the apparatus itself becomes great and the production cost is also raised and when an organic photosemiconductor layer is coated and formed as a photosensitive layer of a toner image-carrier, the problem that the chemical resistance of the basic substance against a solvent is not sufficient may exist. Therefore it is desirable that the basic substance of the toner image-carrier is made of the material whose principal component is polyphenylenesulphide (hereinafter referred to as PPS for short).

PPS as a material of the basic substance is a polymer composed of a structural unit shown with

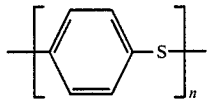

and it has excellent characteristics mentioned below.

(1) excellent in thermal resistance

Since PPS shows that it can resist continuously the temperature of 220°–240° C., the thermal resistance of the photoreceptor drum as an toner image-carrier is sufficient even under the condition of the structure wherein a roll has a heater built-in and toner images on the roll are pre-heated thereby in aforesaid intermediate transfer system.

(2) excellent chemical resistance

Since PPS has an excellent chemical resistance similar to that of fluorine-contained polymers, even under the condition that an organic photosemiconductor layer is formed in particular as a photosensitive layer, the solvent thereof can not cause swelling and others on the basic substance.

(3) light-weight apparatus

Since PPS is light in weight compared with conventional metal drum basic substance, it is possible to make the weight of the drum itself or the weight of the recording apparatus light.

(4) high strength, high rigidity

Since the change in the strength and rigitily of PPS is small and the creep change thereof is also small, PPS is suitable as a material of the photoreceptor basic substance in the intermediate transfer system using heating and pressure.

(5) satisfactory dimensional stability

The dimentional change of PPS is small for a long time in the high temperature ambient atmosphere.

(6) flame resistance

PPS can satisfy the standards (UL 94V-O) of flame resistance without an addition of flame retardant thereto.

(7) excellent electric characteristics

PPS has an excellent electric insulating property and it may also have an electric conductivity if carbon or the like is added thereto.

(8) excellent property for injection molding

PPS has a good flowability and it can be molded (melting temperture is 300° C., for example) like ordinary engineering plastics thus the production cost of the compact can be lowered.

A usable PPS may be EXP type, CZ type (conductive PPS of strengthened-by-carbon fiber type), FZ type (strengthened-by-glass fiber type) and RYTON (strengthened-by-glass fiber type), all of which are manufactured by Dainippon Ink & Chemicals Inc., for example:

EXP 8-2
EXP 9-3
EXP 08 (conductive carbon black-contained)
CZ-1130 (carbon fiber 30%)
FCZ-1230
CZL-4003 (strengthened-by-carbon fiber/fluorine-contained polymers type)
FZ-1140 (glass fiber 40%)
FZ-3360 (strengthened-by-glass fiber/inorganic filler type)
FZL-4033 (strengthened-by-glass fiber/fluorine-contained polymers type)
RYTON R-3, R-4, R-5 (glass fiber 30–45% for all)
RYTON R-9
RYTON R-10 7006A, R-10 5002C, R-10 7007A, R-10 5004A (all are of strengthened-by-glass fiber/inorganic filler type)

Thus, PPS to be used as a material for the basic substance has sufficient strength, thermal resistance and low specific gravity and it sometimes shows its conductivity depending on the additives thereof. When the conductive PPS is used, it is not necessary to provide a conductive layer (e.g., metallic film) between the photosensitive layer and the basic substance and for this reason, it is desirable that the volume specific resistance of PPS basic substance is not more than $10^9$ —cm. When said conductive layer is provided, it is recommended that the volume specific resistance of the conductive layer is not more than $10^3$ —cm.

Incidentally, the photoreceptor drum is heated by the intermediate transfer roll and therefore radiator fins may be provided as one body on the internal surface of the basic substance of the photoreceptor drum for the purpose of preventing the deterioration of characteristics of the photosensitive layer on the surface of the photoreceptor drum. The structure material of the basic substance may be PPS itself or it may be the one wherein additives are added to PPS as mentioned above.

What is claimed is:

1. In a recording apparatus having an intermediate transfer member for transferring a developed electrostatic image formed on an image-carrier to a recording material, means for heating said intermediate transfer member so as to heat toner transferred on said intermediate transfer member from said image-carrier, means for pressing said recording material in contact with said intermediate transfer member, and means cooperating with said pressing means for heating said recording material prior to the contact point between said pressing means and said intermediate transfer member, said heated intermediate transfer member and heating means in cooperation with said pressing means being in proximity to said image-carrier and defining at least in part a space between said image-carrier and said contact point between said intermediate transfer member and said pressing means, wherein the improvement comprises a shielding member of porous metal positioned in said defined space for preventing water vapor generated from said recording material heated by said heated intermediate transfer member and said heating means in conjunction with said pressing means from reaching the surface of said image-carrier, said shielding member preventing water vapor and/or heat produced at said heating section for the recording material from reaching said image-carrier and having at least a trapping capability for condensing and trapping the water vapor.

2. The recording apparatus as claimed in claim 1, wherein a pan is provided under aforesaid shielding member for receiving the water trapped by said shielding member.

3. The recording apparatus as claimed in claim 1, wherein a conduit tube is provided under aforesaid shielding member for receiving the water trapped by said shielding member and discharging it out of the recording apparatus.

4. The recording apparatus as claimed in claim 1, wherein aforesaid shielding member is provided near the circumferential surface of the image-carrier between a toner-image-transferring section and a residual toner-cleaning section.

5. The recording apparatus as claimed in claim 1, wherein aforesaid recording material is a recording paper.

6. The recording apparatus of claim 1, wherein there is provided said an exhausting means which takes in the air containing water vapor and/or heat produced from said heating section and discharges it out of the recording apparatus.

7. The recording apparatus of claim 6 wherein an intake of said exhausting means covers the heating section for the recording material.

8. The recording apparatus of claim 1 wherein said recording material contacts the circumferential surface of the pressure roller which contacts and is driven by said intermediate transfer member and is transported and pre-heated until it is pressed, at the transferring and fixing section, to toner images pre-heated on said intermediate transfer member.

9. The recording apparatus as described in claim 1, further comprising cooling means for said image-carrier comprising a plurality of fins mounted within said image-carrier.

10. In a recording apparatus having an intermediate transfer member for transferring a developed electrostatic image formed on an image-carrier to a recording material, means for heating said intermediate transfer member so as to heat toner transferred on said intermediate transfer member from said image-carrier, means for pressing said recording material in contact with said intermediate transfer member, and means cooperating with said pressing means for heating said recording material prior to the contact point between said pressing means and said intermediate transfer member, said heated intermediate transfer member and heating means in cooperation with said pressing means being in proximity to said image-carrier and defining at least in part a space between said image-carrier and said contact point between said intermediate transfer member and said pressing means, wherein the improvement comprises a shielding member, a surface of said shielding member opposite to the image-carrier side is lined with a porous member positioned in said defined space for preventing water vapor generated from said recording material heated by said heated intermediate transfer member and said heating means in conjunction with said pressing means from reaching the surface of said image-carrier, said shielding member preventing water vapor and/or heat produced at said heating section for the recording material from reaching said image-carrier and having at least a trapping capability for condensing and trapping the water vapor.

* * * * *